US010218095B2

(12) United States Patent
Norton et al.

(10) Patent No.: US 10,218,095 B2
(45) Date of Patent: Feb. 26, 2019

(54) PRESS-FIT PIN CONVERTERS

(71) Applicant: Hewlett Packard Enterprise Development LP, Houston, TX (US)

(72) Inventors: John Norton, Houston, TX (US); Kevin Leigh, Houston, TX (US)

(73) Assignee: Hewlett Packard Enterprise Development LP, Houston, TX (US)

( * ) Notice: Subject to any disclaimer, the term of this patent is extended or adjusted under 35 U.S.C. 154(b) by 0 days.

(21) Appl. No.: 15/571,059

(22) PCT Filed: Apr. 29, 2016

(86) PCT No.: PCT/US2016/030250
§ 371 (c)(1),
(2) Date: Nov. 1, 2017

(87) PCT Pub. No.: WO2017/189008
PCT Pub. Date: Nov. 2, 2017

(65) Prior Publication Data
US 2018/0115089 A1 Apr. 26, 2018

(51) Int. Cl.
*H01R 12/00* (2006.01)
*H01R 13/41* (2006.01)
(Continued)

(52) U.S. Cl.
CPC ..... *H01R 9/092* (2013.01); *H01R 12/58* (2013.01); *H01R 12/71* (2013.01); *H01R 12/73* (2013.01);
(Continued)

(58) Field of Classification Search
CPC .... H01R 9/092; H01R 43/205; H01R 13/629; H01R 13/05; H01R 43/305; G01R 1/0483;
(Continued)

(56) References Cited

U.S. PATENT DOCUMENTS 6,024,584 A 2/2000 Lemke et al.
6,050,836 A * 4/2000 Tohyama ..... G01R 1/0408 439/266
(Continued)

FOREIGN PATENT DOCUMENTS

CN 1823560 8/2006
JP 3572795 10/2004
(Continued)

OTHER PUBLICATIONS

How to Specify High-Speed Mezzanine Connectors, Jul. 14, 2015, 14 pps, <http://www.connectorsupplier.com/how-to-specify-high-speed-mezzanine-connectors/>.
(Continued)

*Primary Examiner* — Jean F Duverne
(74) *Attorney, Agent, or Firm* — Brooks, Cameron & Huebsch, PLLC

(57) ABSTRACT

In one example, a system for a press-fit pin converter includes a first housing coupled to a second housing to enclose a portion of a press-fit contact pin between the first housing and the second housing, where a side of the first housing provides a ball grid array (BGA) connection and a side of the second housing provides a press-fit pin connection.

7 Claims, 3 Drawing Sheets

(51) Int. Cl.

| | |
|---|---|
| ***H01R 12/71*** | (2011.01) |
| ***H01R 13/05*** | (2006.01) |
| ***H01R 13/629*** | (2006.01) |
| ***H01R 12/58*** | (2011.01) |
| ***H01R 12/73*** | (2011.01) |

(52) U.S. Cl.
CPC ..... *H01R 13/05* (2013.01); *H01R 13/41* (2013.01); *H01R 13/629* (2013.01)

(58) Field of Classification Search
CPC . G01R 1/0466; G01R 1/07371; H05K 7/1069
USPC ..... 439/78
See application file for complete search history.

(56) References Cited

U.S. PATENT DOCUMENTS

| | | | | |
|---|---|---|---|---|
| 6,083,013 | A * | 7/2000 | Yamagishi | H05K 7/1069 439/331 |
| 6,229,320 | B1 * | 5/2001 | Haseyama | G01R 1/0466 324/750.25 |
| 6,292,003 | B1 * | 9/2001 | Fredrickson | G01R 1/0483 324/750.25 |
| 6,875,135 | B2 | 4/2005 | Bianchini | |
| 6,932,618 | B1 | 8/2005 | Nelson | |
| 7,210,225 | B2 * | 5/2007 | Olson | H01R 43/205 29/882 |
| 7,663,890 | B2 | 2/2010 | Nelson | |
| 7,918,683 | B1 | 4/2011 | Hamner | |
| 7,985,079 | B1 | 7/2011 | Wilson | |
| 8,764,464 | B2 | 7/2014 | Buck | |
| 2005/0124187 | A1 | 6/2005 | Olson et al. | |
| 2009/0061661 | A1 | 3/2009 | Shuey et al. | |
| 2011/0057664 | A1 * | 3/2011 | Miyata | G01R 1/07371 324/537 |

FOREIGN PATENT DOCUMENTS

| | | |
|---|---|---|
| JP | 2007-122923 | 5/2007 |
| JP | 2009-199878 | 9/2009 |
| JP | 2013-089464 | 5/2013 |
| KR | 10-1370409 | 3/2014 |

OTHER PUBLICATIONS

EPO, Extended European Search Report, dated Dec. 13, 2018, EP Application No. 16895739.7, 8 pages.

* cited by examiner

PRESS-FIT PIN CONVERTERS

BACKGROUND

Computing systems can include a system board with a number of socket connectors to couple module boards to the system board. The module boards can be hot-pluggable transceiver modules. The hot-pluggable transceiver modules, such as 1-lane Small Form Factor Pluggable (SFP), 4-lane Quad Small Form Factor Pluggable (QSFP), and 12-Lane CXP, can be used for network data communications. The transceiver modules can be hot-pluggable to the system board, such as a printed circuit board of a switch module. A system board can be behind a faceplate where connectors for coupling communication cables (e.g., fiber optic cables) to the transceiver modules are arranged.

DETAILED DESCRIPTION

Figure 1:
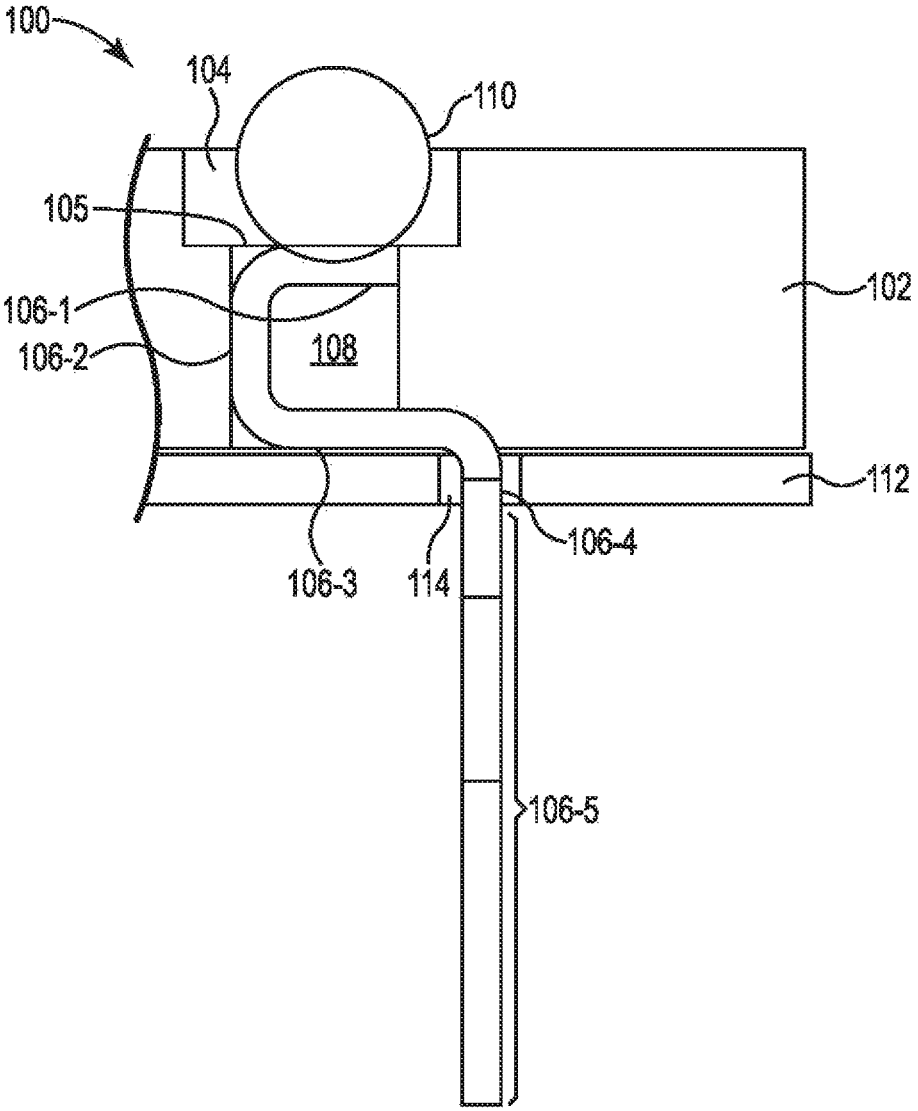
FIG. 1 illustrates a diagram of an example of a system for a press-fit pin converter consistent with the present disclosure.

A number of examples for a press-fit pin converter are described herein. In one example, a system for a press-fit pin converter includes a first housing coupled to a second housing to enclose a portion of a press-fit contact pin between the first housing and the second housing; where a side of the first housing provides a ball grid array (BGA) connection and a side of the second housing provides a press-fit pin connection. In another example, a system for a press-fit pin converter includes a first housing comprising trenches to receive solder balls, a second housing comprising apertures to receive a first portion of a plurality of press-fit pins, and an alignment feature (e.g., pin to help alignment and coupling, etc.) to align a second portion of the plurality of press-fit pins into an enclosure between the first housing and the second housing when the first housing is coupled to the second housing. As used herein, a press-fit pin includes a pin that can be pressed into a plated through hole of a circuit board (e.g., printed circuit board (PCB), etc.). In some examples, the connection of the press-fit pin and the plated through hole can generate an electro-mechanical connection (e.g., gas tight electrical connection, etc.).

In some examples, the press-fit pin converters described herein can be utilized as a ball grid array (BGA) to press-fit pin converter for coupling a PCB. In some examples, an electrical module (e.g., optical transceiver module, optical module, electrical signal regenerator, logic chip, electrical connector, etc.) may be coupled to the PCB. In some examples, the press-fit pin converters described herein can be utilized to couple a number of computing boards and/or cards. For example, the press-fit pin converter can electrically couple to an interposer card on the first side with BGA contacts, and to a mezzanine card on the second side with press-fit pins, where the interposer card may be coupled to an electrical module such as an optical module.

That is, in some examples, the press-fit pin converter can provide an optical interface for a mezzanine card via the interposer card. In another example, the press-fit pin converter can enable an electrical module interposer board to reuse a pinout/footprint of an electrical mid-plane connector (with press-fit pins) on the mezzanine card. In some examples, the press-fit pin converters described herein can provide a lower development cost compared to redesigning the mezzanine card for an optical interface.

In some examples, the press-fit pin converter can reuse a press-fit footprint initially implemented on a first PCB for a press-fit connector, such as attaching a second PCB instead of a press-fit connector. The press-fit connector on the first PCB may be utilized for blind-mating of the first PCB to a backplane PCB. On the second PCB, there can be implementations including, but not limited to: QSFP receptacles with surface-mount contacts to accept an optical transceiver, a mid-board optics optical transceiver, an electrical signal regenerator, logic ICs, and/or backplane connectors with press-fit contacts, among other implementations. In one example, the second PCB can be utilized to alter the initial backplane connector position and/or type to mate the second PCB with a different backplane.

FIG. 1 illustrates a diagram of an example of a system 100 for a press-fit pin converter consistent with the present disclosure. The system 100 can illustrate a single press-fit pin coupled between a first housing 102 and a second housing 112. In some examples, the press-fit pin can include a number of segments 106-1, 106-2, 106-3, 106-4, 106-5. In some examples, the press-fit pin can comprise a conductive material (e.g., metal, metalloid, etc.) In some examples, the first housing 102 and the second housing 112 can comprise an insulated material (e.g., plastic, polymer, etc.).

In some examples, the press-fit pin can include a straight portion (e.g., segment 106-5) that can be utilized to couple the press-fit pin to a receptacle (e.g., plated through hole of a circuit board, etc.). In some examples, the press-fit pin can include a bent portion (e.g., segments 106-1, 106-2, 106-3) that is enclosed between the first housing 102 and the second housing 112. In some examples, the bent portion of the press-fit pin can be a single piece that is bent into a C-shaped portion on one end of the press-fit pin. For example, the press-fit pin can comprise a first bend at 106-4 that is substantially perpendicular to the segment 106-5 to create the segment 106-3. In this example, the press-fit pin can comprise a second bend that is substantially perpendicular to the segment 106-3 to create the segment 106-2. In this example, the press-fit pin can comprise a third bend that is substantially perpendicular to the segment 106-2 to create segment 106-1.

In one example, the C-shaped portion can include a first section (e.g., section 106-3) coupled to an exposed portion (e.g., segment 106-5) of the press-fit contact pin, where the first section is substantially perpendicular to the exposed portion of the press-fit contact pin. In this example, the C-shaped portion can include a second section (e.g., section 106-2) coupled to the first section, where the second section is substantially perpendicular to the first section. In this example, the C-shaped portion can also include a third section (e.g., section 106-1) coupled to the second section, where third section is substantially perpendicular to the second section and substantially parallel to the first section. In some examples, the section 106-3 is in contact with the second housing 112. In some examples, the section 106-1 is in contact with the first housing 102.

In some examples, segment 106-1 can be substantially parallel to segment 106-3. In some examples, the segment 106-1 and segment 106-3 can be substantially perpendicular to segment 106-5 and substantially parallel with the first housing 102 and the second housing 112. In some examples, the segments 106-1, 106-2, 106-3 can be enclosed between the first housing 102 and the second housing 112 within an enclosure 108. In some examples, the segment 106-5 can be an exposed portion of the press-fit pin that extends through an aperture 114 of the second housing 112. In some examples, the segment 106-1 can be an exposed portion through an aperture 105 of the first housing 102. For example, the first housing can include a trench 104 with an aperture 105 to expose the segment 106-1. In some examples, the trench 104 can be utilized to receive a solder ball 110.

In some examples, the system 100 can include a BGA side and a press-fit pin side. For example, the system 100 can provide a converter from the BGA side to the press-fit pin side. In this example, the system 100 can include a BGA on a side of the first housing 102 and can include a press-fit pin on a side of the second housing 112. In some examples, the BGA side of the system 100 can be coupled to an interposer card coupled to an electrical module and the press-fit pin side of the system 100 can be coupled to a mezzanine card.

In some examples, the system 100 can include a plurality of press-fit pins aligned in a particular configuration. In some examples, the system 100 can include a plurality of press-fit pins that are aligned in a bussed ground row. For example, a number of independent press-fit pins for differential-pair signals can be surrounded by a number of ground pins (e.g., ground cage, etc.). In some examples, surrounding the number of independent press-fit pins with the number of ground pins can provide consistent differential impedance and prevent cross-talks among the number of independent press-fit pins.

In some examples, the system 100 can provide optical functionality to a mezzanine card by coupling an electrical module to the mezzanine card. In some examples, the system 100 can couple a BGA connector of the electrical module or interposer card to a press-fit pin connector of the mezzanine card. In some examples, the first housing 102 and/or the second housing can include a number of alignment features to align the system between the mezzanine card and an electrical module. In some examples, the system 100 can include a physical coupling mechanism to physically attach the system between the mezzanine card and the electrical module. In some examples, the system 100 can be utilized to couple other types of printed circuit boards (PCBs). For example, the system 100 can couple a first PCB with a BGA connector to a second PCB with a press-fit pin connector.

Figure 2:
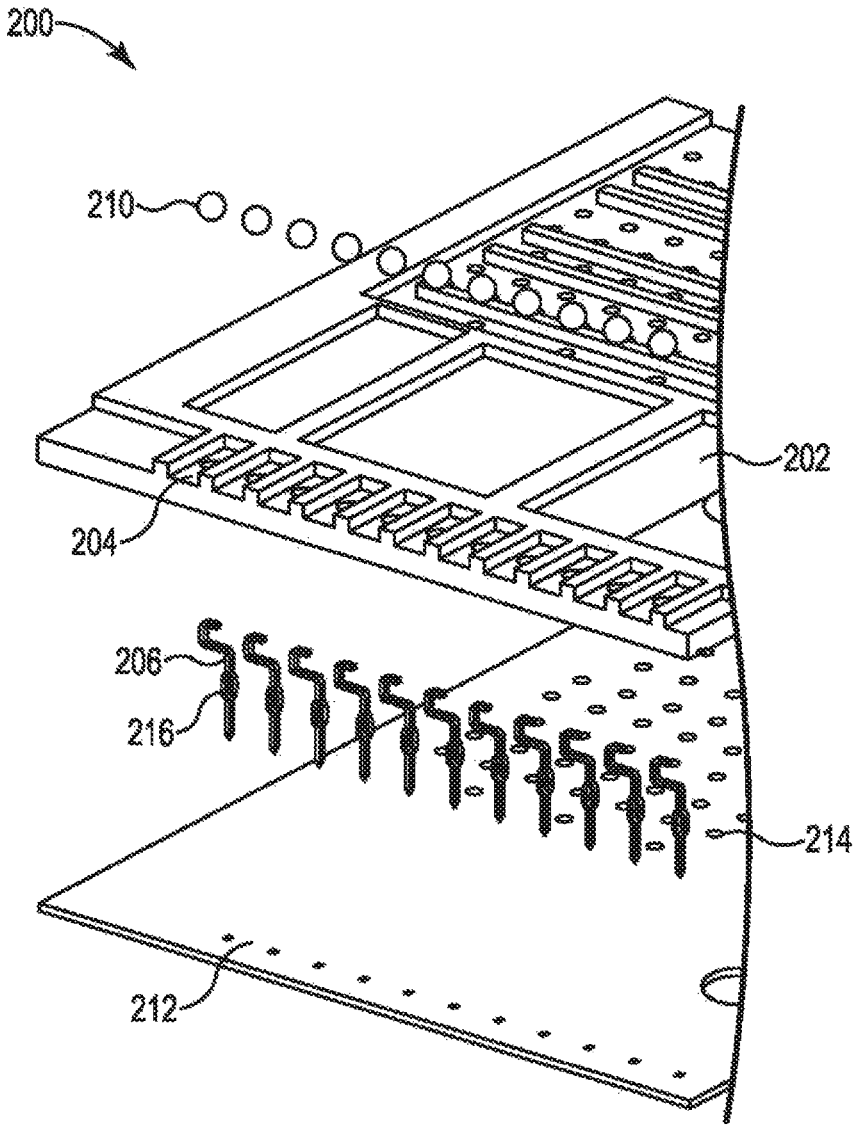
FIG. 2 illustrates a diagram of an example of a system for a press-fit pin converter consistent with the present disclosure.

FIG. 2 illustrates a diagram of an example of a system 200 for a press-fit pin converter consistent with the present disclosure. In some examples, the system 200 can include the same elements as the system 100 as referenced in FIG. 1. The system 200 can illustrate an exploded view of the system 100 as referenced in FIG. 1. For example, the system 200 can illustrate the first housing 202 separated from the second housing 212. In some examples, the first housing 202 and/or the second housing 212 can include an alignment feature to align the plurality of press-fit pins 206 into an enclosure between the first housing 202 and the second housing 212.

In some examples, the system 200 can include a plurality of press-fit pins 206 with a C-shaped portion comprising a number of segments to be enclosed between the first housing 202 and the second housing 212 when the first housing 202 is coupled to the second housing 212. In some examples, the plurality of pins can include an eye of needle (EON) portion 216. In some examples, the EON portion 216 can provide an electro-mechanical connection without damaging a through hole of a PCB when the press-fit pin is coupled to the through hole of the PCB. In some examples, the EON portion 216 can be compressed when inserted into the through hole of the PCB and can provide a spring-like tension within the through hole of the PCB.

In some examples, the second housing 212 can include a number of apertures 214 that correspond to each of the plurality of press-fit pins 206. In some examples, a straight portion of the press-fit pins 206 can be inserted into a corresponding aperture 214. In some examples, the first housing 202 can include a number of troughs 204 with corresponding apertures to expose a segment of the C-shaped portion of the plurality of press-fit pins 206. In some examples, the troughs 204 and corresponding apertures can be utilized to couple the exposed segment of the C-shaped portion to a corresponding solder ball 210.

Figure 3:
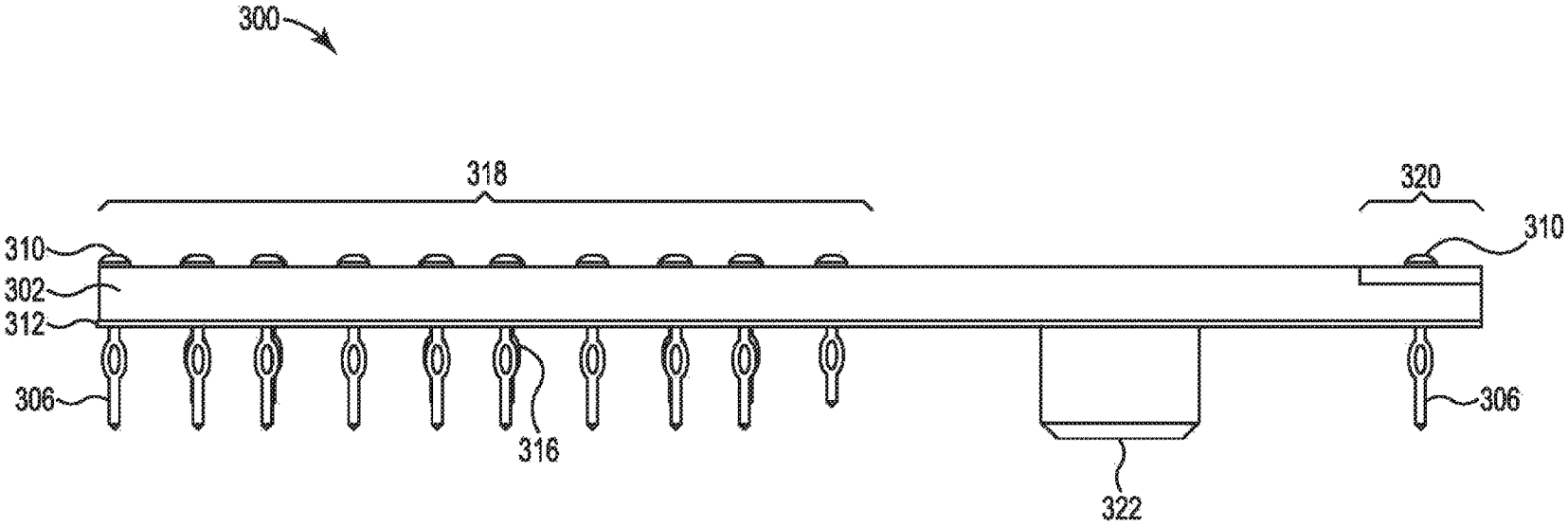
FIG. 3 illustrates a diagram of an example of a system for a press-fit pin converter consistent with the present disclosure.

FIG. 3 illustrates a diagram of an example of a system 300 for a press-fit pin converter consistent with the present disclosure. In some examples, the system 300 can include the same or similar elements as the system 100 as referenced in FIG. 1 and/or the system 200 as referenced in FIG. 2. In some examples, the system 300 can include a plurality of solder balls 310 organized for a BGA connector to receive or couple to a BGA type connector. In some examples, the system 300 can include a plurality of press-fit pins 306 organized for a press-fit pin connector to receive or couple to a press-fit pin connector.

In some examples, the press-fit pins 306 can include an eye of needle (EON) portion 316. As described herein, the EON portion 316 can be utilized to generate an electro-mechanical connection without damaging a through hole of a PCB when the press-fit pin 306 is coupled to the through hole of the PCB. In some examples, the system 300 can include an alignment feature 322 that can be utilized to align the plurality of press-fit pins 106 and/or plurality of solder balls 310 with a corresponding connector. In some examples, the alignment feature 322 can include a physical coupling mechanism to couple the system 300 to a number of connectors (e.g., BGA connectors, press-fit pin connectors, etc.).

In some examples, the system 300 can include a first section 318 and a second section 320. In some examples, the first section 318 can include press-fit pins 306 that can be coupled to an electrical mid-plane connector of a PCB (e.g., mid-plane connector of a mezzanine board, etc.) In some examples, the second section 320 can include press-fit pins 306 that can be utilized to couple to a power source and/or an inter-integrated circuit (I2C).

As used herein, "a" or "a number of" something can refer to one or more such things. For example, "a number of widgets" can refer to one or more widgets. The above specification, examples and data provide a description of the method and applications, and use of the system and method of the present disclosure. Since many examples can be made without departing from the spirit and scope of the system and method of the present disclosure, this specification merely sets forth some of the many possible example configurations and implementations.

What is claimed:

1. A converter, comprising:

a first housing coupled to a second housing to enclose a portion of a press-fit contact pin between the first housing and the second housing, wherein a side of the first housing provides a ball grid array (BGA) connection and a side of the second housing provides a press-fit pin connection;

wherein the enclosed portion of the press-fit contact pin comprises a first section coupled to an exposed portion of the press-fit contact pin, wherein the first section is substantially perpendicular to the exposed portion of the press-fit contact pin; and wherein the first housing includes a trench to expose the first section of the press-fit contact pin.

2. The converter of claim 1, wherein the enclosed portion of the press-fit contact pin further comprises:

a second section coupled to the first section, wherein the second section is substantially perpendicular to the first section; and a third section coupled to the second section, wherein third section is substantially perpendicular to the second section and substantially parallel to the first section.

3. The converter of claim 2, wherein the first section is in contact with the second housing.

4. The converter of claim 2, wherein the third section is in contact with the first housing.

5. The converter of claim 1, wherein the exposed section of the enclosed portion of the press-fit contact pin is coupled to a solder ball.

6. The converter of claim 1, wherein the second housing includes an aperture to expose a portion of the press-fit contact pin.

7. The converter of claim 6, wherein the exposed portion of the press-fit contact pin is coupled to a printed circuit board (PCB).

* * * * *